United States Patent [19]

Barnett et al.

[11] Patent Number: 5,035,978

[45] Date of Patent: Jul. 30, 1991

[54] IMAGE RECEIVING ELEMENT FOR USE IN A SILVER COMPLEX DIFFUSION TRANSFER PROCESS

[75] Inventors: Anthony M. Barnett, Bushey; Colin J. Gray, Harrow; Julie Baker, Rickmansworth, all of England

[73] Assignee: Eastman Kodak Company, Rochester, N.Y.

[21] Appl. No.: 551,363

[22] Filed: Jul. 12, 1990

[30] Foreign Application Priority Data

Oct. 24, 1989 [GB] United Kingdom ..... 8923906

[51] Int. Cl.[5] ..... G03C 5/54

[52] U.S. Cl. ..... 430/233; 430/248; 430/251; 430/965

[58] Field of Search ..... 430/233, 248, 251, 965, 430/611

[56] References Cited

U.S. PATENT DOCUMENTS

| | | | |
|---|---|---|---|
| 2,298,093 | 10/1942 | Dersch et al. | 430/965 |
| 3,062,654 | 11/1962 | Allen et al. | 430/611 |
| 3,779,757 | 12/1973 | Hofman et al. | 430/233 |
| 4,463,082 | 7/1984 | Ferguson et al. | 430/233 |

FOREIGN PATENT DOCUMENTS

| | | | |
|---|---|---|---|
| 614155 | 12/1948 | United Kingdom . | |
| 950668 | 2/1964 | United Kingdom . | |
| 1021015 | 2/1966 | United Kingdom | 430/233 |
| 1158479 | 7/1969 | United Kingdom . | |
| 1190678 | 5/1970 | United Kingdom . | |

*Primary Examiner*—Richard L. Schilling
*Attorney, Agent, or Firm*—Alfred P. Lorenzo

[57] ABSTRACT

A non-light-sensitive image-receiving element useful in a silver complex diffusion transfer process includes at least one layer containing certain tone controlling agents that accelerate the physical development of silver. Compounds useful for this purpose are alkyl disulfides substituted by a water solubilizing group, thiazolidine carboxylic acids, γ-thiobutyrolactones, higher alkyl thioglycolates, and carboxy-substituted rhodanines.

4 Claims, No Drawings

IMAGE RECEIVING ELEMENT FOR USE IN A SILVER COMPLEX DIFFUSION TRANSFER PROCESS

CROSS-REFERENCE TO RELATED APPLICATIONS

U.S. patent application Ser. No. 492,029, "Image Receiving Element For Use In a Silver Complex Diffusion Transfer Process", A. M. Barnett et al, filed Mar. 12, 1990, describes a non-light-sensitive image-receiving element useful in a silver complex diffusion transfer process that includes at least one layer containing certain S-thiuronium alkyl sulfonates which act as tone-controlling agents that accelerate the physical development of silver.

FIELD OF THE INVENTION

This invention relates in general to photography and in particular to image-receiving elements used in silver complex diffusion transfer processes. More specifically, this invention relates to non-light-sensitive image-receiving elements and to the use therein of certain tone controlling agents.

BACKGROUND OF THE INVENTION

In silver complex diffusion transfer processes a light-sensitive silver halide material is image-wise exposed, processed in a developer or activator containing a silver complexing agent, and then contacted with a non-light-sensitive image-receiving layer containing development nuclei (also passed through the processing solution). The image-wise exposed silver halide in the light-sensitive material is developed to silver while the unexposed silver halide portions are transferred by diffusion into the receiving layer whereupon they are converted into silver by the action of the developer on the nuclei. Thus a positive image of the original appears on the receiving layer after separation of the image-receiving material from the light-sensitive silver halide material. This process, having been first described in British Patent No. 614155, is now well known. Certain compounds are now conventionally used in such non-light-sensitive image-receiving layers; for example 2-phenyl-5-mercapto-oxadiazole and 5-methylbenzotriazole. These compounds are utilized to control the density and tone of the positive image.

Other toners, such as those described in British Patents 950668 and 1158479, can either accelerate the production of a positive image as compared to an image-receiving layer having no toner added thereto, or as compared to an image-receiving layer with known development retarding toner, for example 1-phenyl-2-tetrazoline-5-thione.

All these compounds, although efficacious in their way, have drawbacks and accordingly the need exists to improve the performance of non-light-sensitive image-receiving layers and in particular to improve the speed of development which would allow a faster "strip time" and improve resolution and exposure latitude by decreasing sideways diffusion of complexed silver.

SUMMARY OF THE INVENTION

In accordance with this invention, it has been discovered that certain compounds as hereinafter defined have the unexpected effect of accelerating the physical development of silver in non-light-sensitive image-receiving layers in a silver complex diffusion transfer process.

According to one aspect of the present invention there is provided therefore a non-light-sensitive image-receiving element for use in a silver complex diffusion transfer process having in at least one layer thereof at least one compound selected from the group consisting of:

(1) alkyl disulfides substituted by a water solubilizing group,
(2) thiazolidine carboxylic acids,
(3) γ-thiobutyrolactones,
(4) higher alkyl thioglycolates, and
(5) carboxy-substituted rhodanines.

In a second aspect, the invention provides a silver complex diffusion transfer process, which process comprises passing a non-light-sensitive image-receiving element and an image-wise exposed light-sensitive silver halide element through a processing solution, laminating them in face to face contact, and stripping them apart when processing is over, said non-light-sensitive image-receiving element including at least one compound as above defined, thereby to accelerate the physical development of silver in the image-receiving layer.

DESCRIPTION OF THE PREFERRED EMBODIMENTS

The water solubilizing group of the alkyl disulfide is preferably a carboxylic group and the alkyl group is preferably propyl. Accordingly, the preferred compound is 3-carboxypropyl disulfide. This compound is described in U.S. Pat. No. 3,779,757 which relates to carboxyl-alkyl substituted disulfides for use in the stabilization of photographic images in the silver halide diffusion transfer process. There is no disclosure of its use as a tone controller.

The thiazolidine carboxylic acids employed in this invention can be substituted or unsubstituted. A particularly preferred compound of this type is thiazolidine-4-carboxylic acid of the formula:

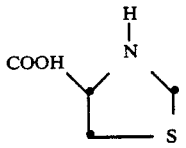

Compounds of this general type have been described in British Patent No. 1,190,678 but only for use in light-sensitive photographic emulsions. There is no suggestion of their use as tone controllers in accordance with the present invention.

The γ-thiobutyrolactones employed in the present invention have the formula:

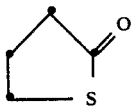

They can be substituted or unsubstituted, but preferably are unsubstituted.

The higher alkyl thioglycolates employed in the present invention are those with at least six and preferably at least ten carbon atoms in the alkyl group. For example, a preferred compound of this type is octadecyl thioglycolate of the general formula:

$$HS—CH_2—COO—(CH_2)_{17}—CH_3$$

Compounds of this general type have been described in U.S. Pat. No. 4,463,082 which reveals the utilization of propyl thioglycolate in admixture with a noble metal stabilizer. There is no disclosure of the use of the higher alkyl thioglycolates per se as tone controllers.

The carboxy-substituted rhodanines employed in the present invention have the general formula:

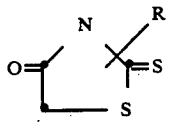

wherein R represents a $—(CH_2)_n—COOH$ group wherein n is 0 to 6, and is most preferably an acetic acid group at the 3-position. Thus, the most preferred compound is rhodanine-3-acetic acid.

In all the foregoing cases, the toner accelerates the physical development of silver in the presence of development nuclei when incorporated in a non-light-sensitive image receiving layer of a silver halide diffusion transfer process. These compounds may be used alone or in combination with other known toners in two or three layer receiver formats on film or on paper base at different levels of swell. They also may be used singularly or in admixture with each other.

When processed with a light-sensitive projection negative donor the faster developing receiver layers give improved resolution and exposure latitude without significant lowering of contrast. Furthermore, the maximum transmission densities obtained after 6, 12 or 30 seconds' lamination are found to be increased over those achievable with the compounds of the prior art. Furthermore, when processed with a light-sensitive Kodak PMTII Continuous Tone Negative donor, the faster developing receiver layers are able to give improved (i.e., lower) contrast over that achievable with the compounds of the prior art.

The toners of this invention can be employed at concentrations from 1 to 500 mg/m$^2$, preferably from 20 to 150 mg/m$^2$.

The invention will now be described, by way of illustration only, with reference to the following examples.

EXAMPLE 1

The toner, 3-carboxypropyl disulfide, was coated in a three-layer receiver format on paper base.

i) Samples were processed using PMTII activator in a suitable diffusion transfer processor (e.g., Kodak Imagemate 43DT) with an unexposed PMTII projection negative, stripped apart immediately after the trailing edge had left the processor, and development stopped instantly by immersing in a 5% acetic acid solution. The transmission density (DT) of the transferred silver was measured for 6 and 12 seconds lamination (Table 1).

TABLE 1

| Toner | DT (6s) | DT (12s) |
|---|---|---|
| 3-carboxypropyl disulfide | 0.59 | 0.90 |
| 5-methylbenzotriazole (Prior art) | 0.41 | 0.65 |
| 2-phenyl-5-mercapto-oxadiazole (Prior art) | 0.42 | 0.72 |

TABLE 1-continued ii) Samples were processed with a step-wedge exposed PMTII continuous tone donor, stripped apart after 60 seconds lamination, the reflection density-log exposure curve measured, and the 5–90 contrast index noted (Table 2).

TABLE 2

| Toner | 5–90 Contrast |
|---|---|
| 3-carboxypropyl disulfide | 0.94 |
| 5-methylbenzotriazole (Prior art) | 1.53 |
| 2-phenyl-5-mercapto-oxadiazole (Prior art) | 2.60 |

The results show that the toner of this invention accelerates the production of positive image, compared to the two cited toners of the prior art.

EXAMPLE 2

The toner, thiazolidine-4-carboxylic acid, was coated in a three-layer receiver format on paper base, in a conventional manner.

i) Samples were processed with unexposed PMTII projection negative, stripped apart immediately after the trailing edge had left the processor, and development stopped instantly by immersing in a 5% acetic acid solution. The transmission density (DT) of the transferred silver was measured for 6 and 12 seconds lamination (Table 3).

TABLE 3

| Toner | DT (6s) | DT (12s) |
|---|---|---|
| thiazolidine-4-carboxylic acid | 0.56 | 0.90 |
| 5-methylbenzotriazole (Prior art) | 0.41 | 0.65 |
| 2-phenyl-5-mercapto oxadiazole (Prior art) | 0.42 | 0.72 |

ii) Samples were processed with a step-wedge exposed PMTII continuous tone donor, stripped apart after 60 seconds lamination, the reflection density-log exposure curve measured, and the 5–90 contrast index noted (Table 4).

TABLE 4

| Toner | 5–90 Contrast |
|---|---|
| thiazolidine-4-carboxylic acid | 1.07 |
| 5-methylbenzotriazole (Prior art) | 1.53 |
| 2-phenyl-5-mercapto-oxadiazole (Prior art) | 2.60 |

The results show that the toner of this invention accelerates the production of positive image, compared to the two cited toners of the prior art.

EXAMPLE 3

The toner, γ-thiobutyrolactone, was coated in a three-layer receiver format on paper base, in the conventional manner.

i) Samples were processed with unexposed PMTII projection negative, stripped apart immediately after the trailing edge had left the processor, and development stopped instantly by immersing in a 5% acetic acid solution. The transmission density (DT) of the transferred silver was measured for 6 and 12 seconds' lamination (Table 5).

TABLE 5

| Toner | DT (6s) | DT (12s) |
|---|---|---|
| γ-thiobutyrolactone | 0.67 | 0.91 |
| 5-methylbenzotriazole (Prior art) | 0.41 | 0.65 |
| 2-phenyl-5-mercapto-oxa-diazole (Prior art) | 0.42 | 0.72 |

ii) Samples were processed with a step-wedge exposed PMTII continuous tone donor, stripped apart after 60 seconds' lamination, the reflection density-log exposure curve measured, and the 5–90 contrast index noted (Table 6).

TABLE 6

| Toner | 5–90 Contrast |
|---|---|
| γ-thiobutyrolactone | 1.17 |
| 5-methylbenzotriazole (Prior art) | 1.53 |
| 2-phenyl-5-mercapto-oxa-diazole (Prior art) | 2.60 |

The results show that the toner of this invention accelerates the production of positive image, compared to the two cited toners of the prior art.

EXAMPLE 4

The toner, octadecyl thioglycolate, was coated in a three-layer receiver format on paper base, in the conventional manner.

i) Samples were processed with unexposed PMTII projection negative, stripped apart immediately after the trailing edge had left the processor, and development stopped instantly by immersing in a 5% acetic acid solution. The transmission density (DT) of the transferred silver was measured for 6 and 12 seconds' lamination (Table 7).

TABLE 7

| Toner | DT (6s) | DT (12s) |
|---|---|---|
| octadecyl thioglycolate | 0.64 | 0.94 |
| 5-methylbenzotriazole (Prior art) | 0.41 | 0.65 |
| 2-phenyl-5-mercapto-oxa-diazole (Prior art) | 0.42 | 0.72 |

ii) Samples were processed with a step-wedge exposed PMTII continuous tone donor, stripped apart after 60 seconds' lamination, the reflection density-log exposure curve measured, and the 5–90 contrast index noted (Table 8).

TABLE 8

| Toner | 5–90 Contrast |
|---|---|
| octadecyl thioglycolate | 0.97 |
| 5-methylbenzotriazole (Prior art) | 1.53 |
| 2-phenyl-5-mercapto-oxa-diazole (Prior art) | 2.60 |

The results show that the toner of this invention accelerates the production of positive image, compared to the two cited toners of the prior art.

EXAMPLE 5

The toner, rhodanine-3-acetic acid, was coated in a three-layer receiver format on paper base, in a conventional manner.

i) Samples were processed using PMTII activator in a suitable diffusion transfer processor (e.g., Kodak Imagemate 43DT) with unexposed PMTII projection negative, stripped apart immediately after the trailing edge had left the processor, and development stopped instantly by immersing in a 5% acetic acid solution. The transmission density (DT) of the transferred silver was measured for 6 and 12 seconds lamination (Table 9).

TABLE 9

| Toner | DT (6s) | DT (12s) |
|---|---|---|
| rhodanine-3-acetic acid | 0.62 | 0.91 |
| 5-methylbenzotriazole (Prior art) | 0.41 | 0.65 |
| 2-phenyl-5-mercapto-oxa-diazole (Prior art) | 0.42 | 0.72 |

ii) Samples were processed with a step-wedge exposed PMTII continuous tone donor, stripped apart after 60 seconds' lamination, the reflection density-log exposure curve measured, and the 5–90 contrast index noted (Table 10).

TABLE 10

| Toner | 5–90 Contrast |
|---|---|
| rhodanine-3-acetic acid | 0.75 |
| 5-methylbenzotriazole (Prior art) | 1.53 |
| 2-phenyl-5-mercapto-oxa-diazole (Prior art) | 2.60 |

The results show that the toner of this invention accelerates the production of positive image, compared to the two cited toners of the prior art.

The invention has been described in detail with particular reference to preferred embodiments thereof, but it will be understood that variations and modifications can be effected within the spirit and scope of the invention.

What is claimed is:

1. A non-light-sensitive image-receiving element for use in a silver complex diffusion transfer process; said element including a silver receptive layer containing development nuclei which function to form an image from said silver complex and said element comprising, in at least one layer thereof, at least one tone-controlling compound selected from the group consisting of thiazolidine carboxylic acids, γ-thiobutyrolactones and higher alkyl thioglycolates wherein the higher alkyl group contains at least six carbon atoms; said tone-controlling compound being incorporated in said element in an amount, within the range of 1 to 500 mg/m$^2$, sufficient to accelerate the physical development of silver occurring in the presence of said development nuclei in said silver complex diffusion transfer process.

2. A non-light-sensitive image-receiving element as claimed in claim 1 wherein said tone-controlling compound is thiazolidine-4-carboxylic acid.

3. A non-light-sensitive image-receiving element as claimed in claim 1 wherein said tone-controlling compound is γ-thiobutyrolactone.

4. A non-light-sensitive image-receiving element as claimed in claim 1 wherein said tone-controlling compound is octadecyl thioglycolate.

* * * * *